United States Patent [19]

Dolejs et al.

[11] Patent Number: 4,858,744

[45] Date of Patent: Aug. 22, 1989

[54] CURRENCY VALIDATOR

[75] Inventors: Anthony H. Dolejs, Bedford Heights; Henry M. Stopar; Patrick Swetel, both of Eastlake, all of Ohio

[73] Assignee: Ardac, Inc., Eastlake, Ohio

[21] Appl. No.: 156,038

[22] Filed: Feb. 16, 1988

[51] Int. Cl.[4] ..... G07F 7/04; G07D 7/00

[52] U.S. Cl. ..... 194/206; 209/534; 271/181

[58] Field of Search ..... 194/206, 207; 209/534, 209/569; 271/180, 181

[56] References Cited

U.S. PATENT DOCUMENTS

| | | | |
|---|---|---|---|
| 3,153,483 | 10/1964 | Simjian | 194/207 X |
| 3,245,534 | 4/1966 | Smith et al. | 194/206 X |
| 3,293,543 | 12/1966 | Nelson et al. | 209/569 X |
| 3,917,260 | 11/1975 | Okkonen | 194/206 X |
| 3,977,669 | 8/1976 | Douno | 271/180 |
| 4,513,439 | 4/1985 | Gorgone et al. | 194/206 X |
| 4,678,072 | 7/1987 | Kobayashi et al. | 194/206 |

FOREIGN PATENT DOCUMENTS

| | | | |
|---|---|---|---|
| 2453811 | 12/1980 | France | 194/207 |
| 2122008 | 1/1984 | United Kingdom | 194/206 |
| 86/05301 | 9/1986 | World Int. Prop. O. | 194/206 |

*Primary Examiner*—F. J. Bartuska

*Attorney, Agent, or Firm*—Renner, Kenner, Greive, Bobak, Taylor & Weber

[57] ABSTRACT

A vertical slot-type currency validator has a note path which includes pressure elements for urging the bill into proper registration with a magnetic reading head within the path. The slot acceptor further includes an optical interrupt and restricting tab which is operative to indicate a bill has actually been stacked while preventing unauthorized attempts at removal of the bill. Further, a sensor is provided at the top of the note path to assure that the note has actually reached the full end of the path and is properly aligned for punching into the stack. A pair of side rails are provided for vertical transport of the bill, such side rails being slightly angled inwardly toward the center of the note path and including ball rollers which facilitate movement of the bill in any direction, and particularly into a stack under control of a punch. The punch includes a rubberized pad overlaying a rigid back plate for efficiently removing the bills for the rails.

9 Claims, 4 Drawing Sheets

CURRENCY VALIDATOR

TECHNICAL FIELD

The invention herein resides in the art of currency validators or acceptors and, more particularly, to vertical slot acceptors. Such acceptors are known in the art as including a note path which has a substantially vertical portion and in which the accepted currency or notes are maintained in a vertical stack, placed therein by a punch which horizontally traverses the vertical note path.

BACKGROUND ART

Various types of currency validators or acceptors have been known in the past. Typically, such acceptors are of one of two types. Slot acceptors generally provide means for receiving the bill or note in a slot, subsequently transporting the note past a test station into a receiving area once the bill has been authenticated. In contradistinction, tray acceptors are of the type in which the bill or currency is laid in a tray and the tray is then manually moved to a test position where the bill is retrieved from the tray if authenticated. The invention herein is particularly concerned with slot acceptors of the type wherein a magnetic head is used to read patterns on the paper, generating electrical signals as a consequence of such reading, and thereafter comparing the electrical signals with known values to determine authenticity. It has been found with such slot acceptors that it is important to maintain good contact between the paper and the magnetic head during the reading operation in order to obtain desired resolution. In the prior art, spring-loaded wheels, either stationary or retractable, have been provided for urging the bill or currency against the reading head. However, with such structures it has been difficult to obtain proper registration since the magnetic reading head is typically arcuate such that the spring-loaded wheels make only point or tangential contact, often resulting in poor readings.

The prior art has also taught the use of a punch to stack currency once it has been authenticated by the slot acceptor. However, the prior art has not included means to sense that the stacking operation has, in fact, been achieved. The prior art has further been devoid of means to restrict or inhibit stringing or unauthorized attempts at removal of the currency from the stack. Yet further, the prior art has been devoid of means to restrict or inhibit bulging of the bills in the stack.

In the prior art it has not been known to provide a sensor at the top or far end of the note path to assure that the bill has, in fact, reached such end. The result is that the bills may crumple within the path, resulting in a degree of inconsistency and uncontrollability within the stack of bills, as well as limiting the number of bills which might be received in the stack.

It is further known that the prior art generally teaches the use of a drive belt to move the notes along the note path and along vertical rails on either side thereof. The rails have typically been provided with wheels which rotate about a fixed axis perpendicular to the path of note travel. Accordingly, when the bill is punched into the stack, the bill is drug across the wheel orthogonal to the customary plane of rotation, often resulting in a torn bill or one which does not completely release itself from the note path. In somewhat similar manner, the prior art has also taught the movement of bills between a driven belt and an idler belt to a punch position. Here again, the bill or note is punched from frictional engagement between the two belts, often resulting in tears, crumpling, or less than total release of the bill from the note path.

In the prior art, the punch has typically comprised a metal plate having a low coefficient of friction. With such a punch, the bill would typically slide laterally on the punch such that one edge of the bill would free itself from the rail before the other, resulting in failure of the bill to be properly stacked. Indeed, it was found that one edge of the bill often never cleared the rail. Further, it was found that bills characterized by a roll or fold had a tendency to wrap around the punch plate and thereby follow the plate on its return cycle such that the bill was never deposited in the stack.

In light of the foregoing, there is a need in the art for a currency validator of the vertical slot type which overcomes the shortcomings earlier presented.

DISCLOSURE OF INVENTION

In light of the foregoing, it is a first aspect of the invention to provide a currency validator which maintains good contact between the currency and a magnetic head over a substantial space.

Another aspect of the invention is the provision of a currency validator which maintains good contact between the currency and the magnetic head and is not given to problems of registration.

Still a further aspect of the invention is the provision of a currency validator which includes means to sense that the stacking of the bill has been completed.

An additional aspect of the invention is the provision of the currency validator which includes means to prohibit stringing or unauthorized retrieval of the bill once it has been stacked.

Still a further aspect of the invention is the provision of a currency validator which includes means to prevent bulging of bills within the stack.

Another aspect of the invention is the provision of a currency validator which includes means at the top or far end of the note path to sense the presence of the end of a note.

An additional aspect of the invention is the provision of a currency validator which includes means to allow easy movement of the bill between the belt and rail and to similarly allow for easy removal of the bill from the rail when punched into the stack.

Another aspect of the invention is the provision of a currency validator having a punch with a coefficient of friction sufficient to engage the bill and retrieve it from both side rails.

A further aspect of the invention in the provision of a currency validator having a punch which is not susceptible to seizure by a folded or rolled bill.

The foregoing and other aspects of the invention which will become apparent as the detailed description proceeds are achieved by a currency validator, comprising: a note path having a horizontal portion leading to a vertical portion; and first sensing means at an end of said vertical portion for sensing the presence of a bill at said end.

Other aspects of the invention are attained by A currency validator, comprising a note path having a horizontal portion leading to a vertical portion; a pair of rails on opposite sides of said vertical portion; and a pair of moveable belts in juxtaposition to said pair of rails.

Still further aspects of the invention are achieved by A currency validator, comprising: a note path having a horizontal portion leading to a vertical portion, said note path defined by a first plate spaced from a second plate, said first plate having an opening therein for receiving a magnetic sensor.

Yet other aspects of the invention are achieved by the currency validator, comprising: a vertical note path; a rail of each of said path; a punch adapted to reciprocatingly traverse said vertical note path between said rails, said punch comprising a rigid plate having a resilient pad attached thereto.

DESCRIPTION OF DRAWINGS

For a complete understanding of the objects, techniques and structure of the invention reference should be had to the following detailed description and accompanying drawings wherein.

BEST MODE FOR CARRYING OUT THE INVENTION

Figure 1:
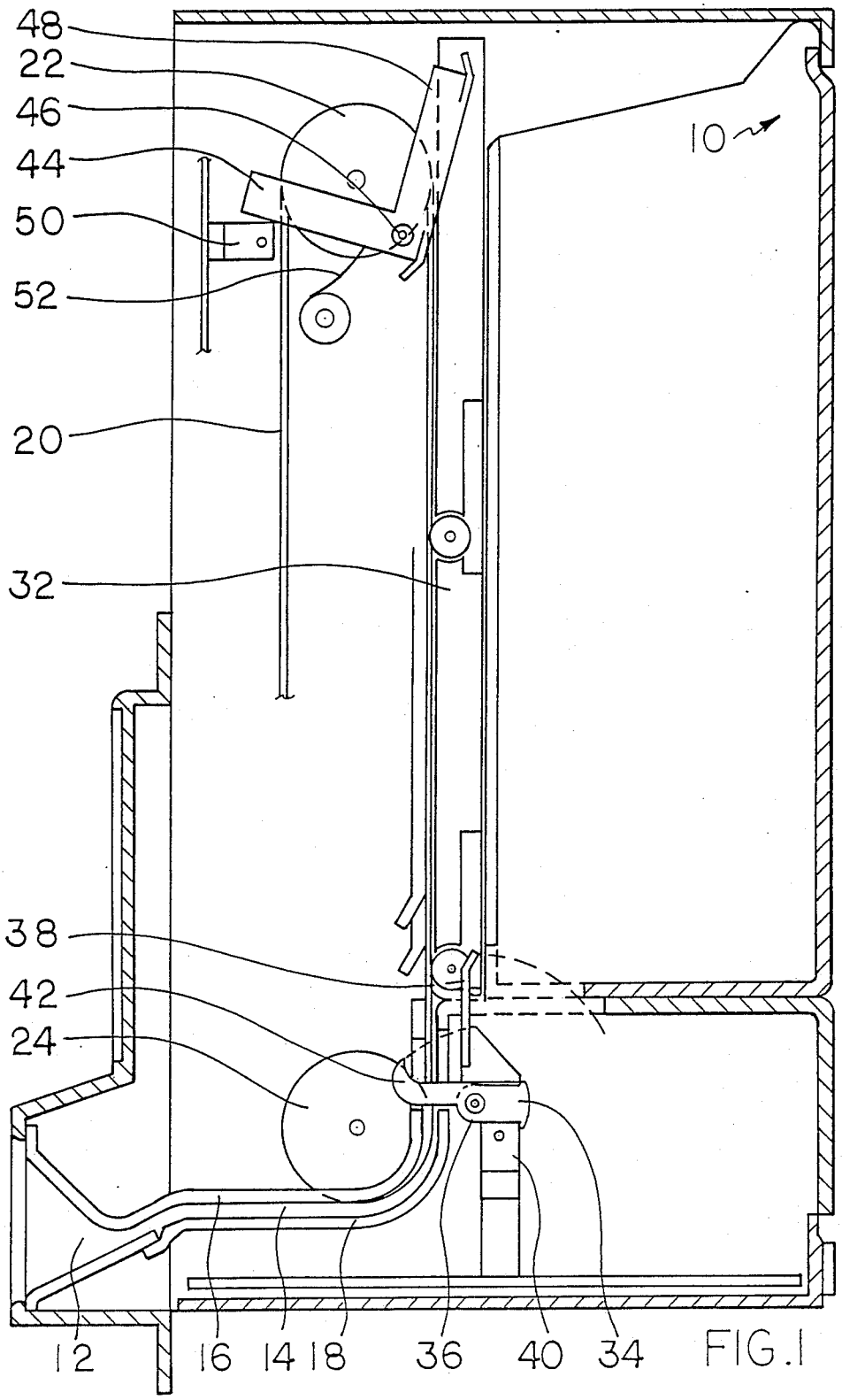
FIG. 1 is side sectional view of the vertical slot acceptor of the invention showing the upper and lower sensors in communication with the note path.
Figure 2:
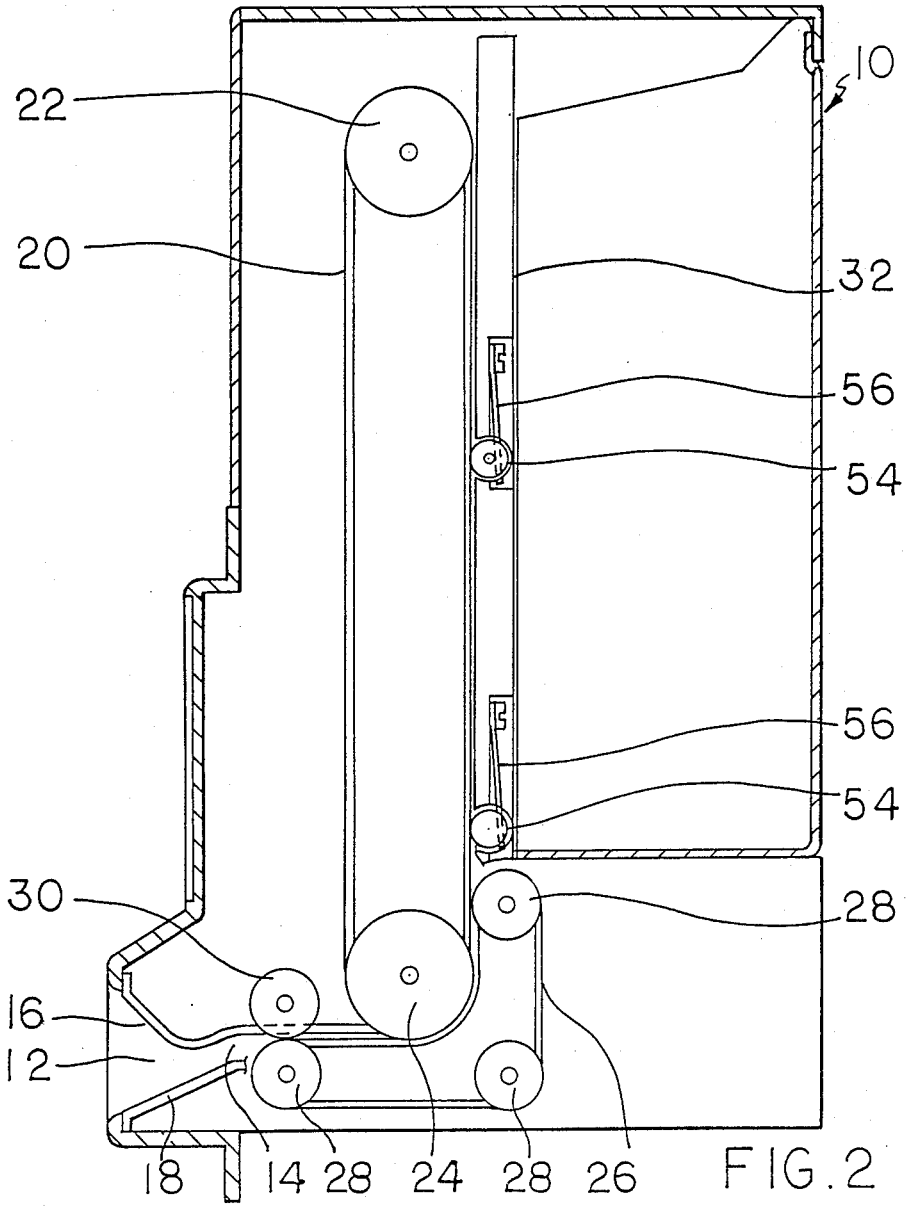
FIG. 2 is another side sectional illustration of the invention particularly showing the side rails thereof in communication with the drive belt and idler belt to achieve note movement.

With reference now to the drawings and more particularly FIGS. 1 and 2, it can be seen that a validator according to the invention is designated generally by the numeral 10. It will be appreciated by those skilled in the art that the validator 10 is of the vertical slot-type, having a slot 12 and a front end thereof adapted for receiving currency placed therein for transportation along a note path 14 defined by top plate 16 and a bottom plate 18. A drive belt 20 communicates with the note path 14, movement thereof being achieved by means of the drive pulley 22 caused to rotate by an appropriate motor or the like. An idler pulley 24 is provided opposite the drive pulley 22 to complete the rotational path of the belt 20. It will also be observed that an idler belt 26 is provided about 3 idler pulleys 28 to generate a bite with a pick-up wheel 30 which is driven by one of the idler pulleys 28. It will appreciated by those skilled in the art that the belt 26 is effectively driven by the belt 20, drive pulley 22 and idler pulley 24. In any event, the bite between the pick-up wheel 30 and idler pulley 28 draws the note into the note path 14 when placed therein through slot 12.

It should be appreciated that the structure of belts, wheels and pulleys 20–30 just described may be duplicated on each side of the currency validator 10 such that the note is grasped on each side of the note path 14. It should be further apparent that the belts 20 communicate with side rails 32, one on each side of the note path 14, in close sliding engagement along the length thereof such that a bill tendered through the slot 12 is moved upwardly along the rails 32 by urging of the associated belt 20.

As shown, the note path 14 is initially horizontal and thence vertical, the validated bills being stacked from the vertical position. To monitor such stacking and to prevent bulging of the bills within the stack, there is provided a vane 34 which is operative about a pivot 36 which includes a tab 38 centrally positioned along the width of the note path. An optical interrupt 40 is in operative communication with the vane 34 to determine when the note or bill has been stacked in a manner to be discussed hereinafter. It should be noted that a counterweight or spring and stop 42 is provided to retain the vane 34 and tab 38 in a normal position.

Maintained at the top of the note path 14 is a vane 44 operative about a pivot 46 and having an actuator bar 48 at an opposite end thereof. The vane 44 is in operative communication with an optical interrupt 50 and is operatively connected to a spring 52 for urging the vane 34 into a normal position. As will become apparent hereinafter, as the bill moves upwards by the belts 20 urging against the associated side rails 32, the actuator bar 48 is engaged, moving the vane 44 into communication with the optical interrupt 50, indicating that the top of the bill has reached the top portion of the note path and, if valid, is available for stacking.

Figure 3:
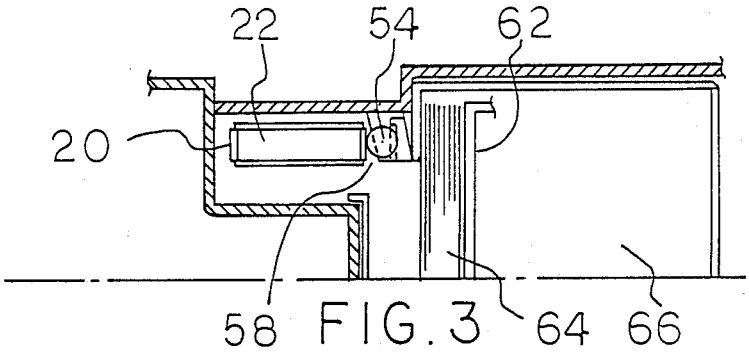
FIG. 3 is a partial top sectional view of the structure of FIG. 2, showing the side rail, belt drive, bill punch, and back-up plate.

As shown in FIGS. 1–3, the side rail 32 includes ball rollers 54 maintained in housed-out areas of the rail 32. The ball rollers 54 are spring biased as by cantilevered springs 56 and protrude through holes in the front of the rail which are of lesser diameter than the balls themselves. Accordingly, the balls are free to rotate about any diameter, allowing for ease of movement of the bills up along the rails as by the belt 20 or transversely from the rails as by the transverse punch 60. As is apparent from FIG. 3, the rails 32 are angled inwardly or toward each other by a slight degree, on the order of 5–15 degrees, and preferably 10 degrees. This slight angle further facilitates the movement of the bills from the rails 32, and particularly where the rails and balls are made of a material having a low coefficient of friction, such as polished steel, Teflon, polypropylene, or the like. The slight angling of the rails 32 is designated in FIG. 3 by the numeral 58.

As shown in FIG. 3, maintained between the drive belts 20 on each side of note path 14, and in the vertical portion thereof, is a punch 60 operative for reciprocating movement through the note path 14 to draw the bill maintained between the drive belt 20 and rail 32 against a spring biased back-up plate 62 and into a stack of bills or notes 64. This type of punching operation is well known in the art and is not elaborated upon herein, although improvements therein will be discussed later with respect to FIGS. 7 and 8. Suffice it to say that the stack of bills continues to fill the cavity 66 as the back-up plate 62 moves progressively to the right as shown in FIG. 3.

It will be appreciated that a magnetic head of some type will be maintained about the note path 14 to read patterns on the paper offered as a valid currency. Typically the magnetic head will be positioned at the bend in the note path 14 taking the note path from a horizontal to a vertical posture. As shown in FIGS. 1 and 2, this bend is coextensive with a portion of the circumference of the idler pulley 24. Accordingly, as the note passes the magnetic head at the bend, the magnetic characteristics of the bill are sensed and an appropriate output signal is generated for determination of authenticity in standard fashion.

Figure 4:
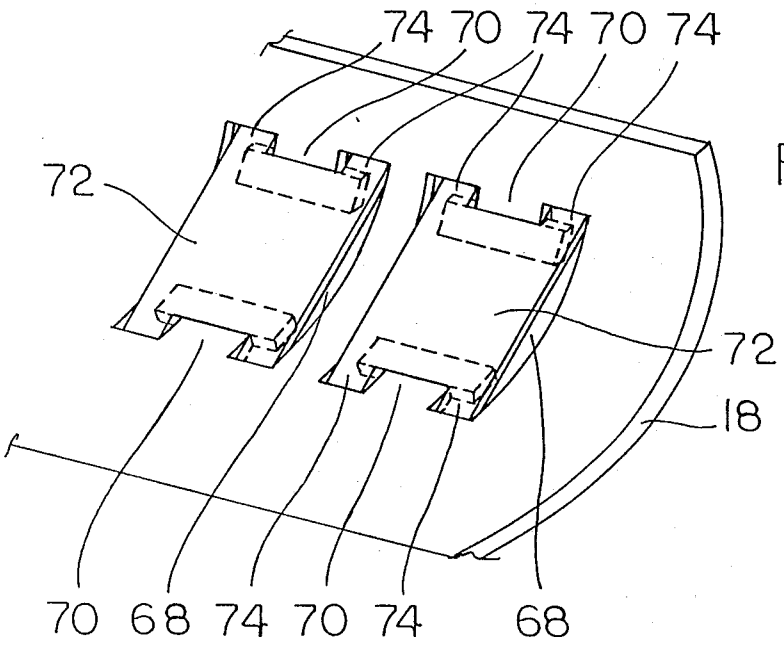
FIG. 4 is an illustrative view of the bottom plate of the note path shown receiving a flexible pressure member for maintain appropriate contact in engagement with a magnetic reading head.
Figure 5:
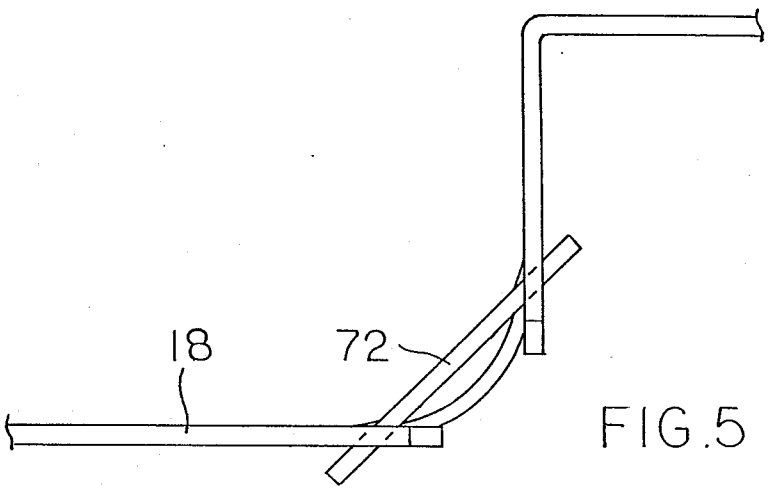
FIG. 5 is a side view of the structure of FIG. 4.
Figure 6:
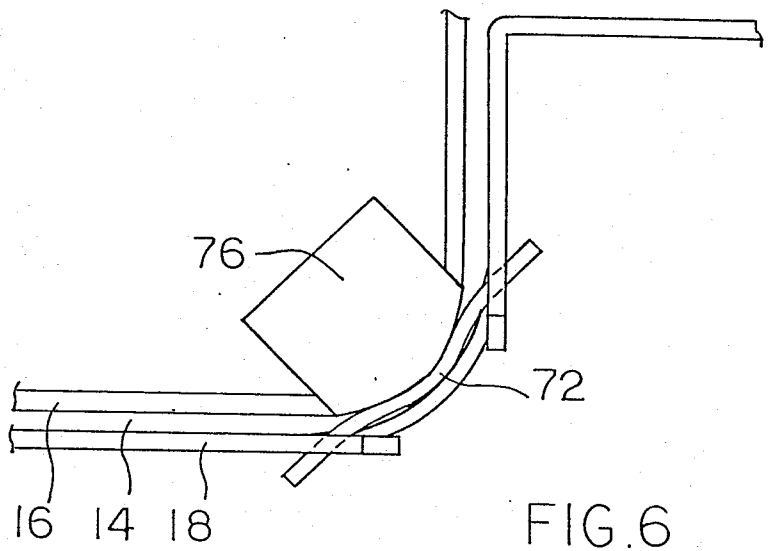
FIG. 6 is a side view of the structure of FIGS. 4 and 5, showing the placement of a magnetic reading head in association therewith.

With reference now to FIGS. 4–6, it can be seen that, at the bend of the bottom plate 18, a pair of cut-outs 68 are provided. Each of the cut-outs 68 includes a bent down tab 70 at the center of each end thereof. A pressure member 72, preferably of flexible plastic, elastomer, Teflon or other similar film, bridges each of the cut-outs as shown. It will be noted the pressure members 72 have a pair of ears 74 at each end thereof to pass on each side of the tab 70. Accordingly, there is a relative degree of movement and flexibility of the pressure members 72 with respect to the bottom plate 18 and cut-outs 68.

With reference now to FIG. 6, it can be seen that magnetic heads 76 may pass through openings in the top plate 16 and be brought into engagement with the flexible pressure members 72 which define the bottom portion of the note path 14 at the bend. The flexible nature of the pressure member 72 causes the member 72 to conform to the arcuate reading surface of the magnetic head 76 such that a bill or note passing along the path 14 will be brought into intimate contact with the magnetic head 76 for accurate reading and high resolution. Misalignment of the magnetic head 76 is automatically compensated by flexure and movement of the pressure member 72. It will be appreciated that a pair of magnetic heads 76 may be used to read two different paths along the bill as it travels.

With an appreciation of the structure of the invention, thus far, attention will now be given to a description of the operation thereof. When a paper is tendered as a valid currency through the slot 12, a sensor detects its presence and causes the drive pulley 22 to rotate. The bill is then taken through the note path 14 by the pulley and belt arrangements described earlier. As the currency passes the magnetic heads 76 at the bend in the note path, a determination is made as to the authenticity of the paper tendered. Should the validity test be passed, once the top of the bill engages the actuator bar 48, activating the optical interrupt 50, a determination is made that the bill is in position for punching into the stack of bills 64. The punch 60 has a cut-out portion which rides over the tab 38 such that the bill itself engages the tab 38, causing the vane 34 to actuate the optical interrupt 40, indicating that the bill has been stacked. When the punch 60 is withdrawn, the stiff tab 38 returns to its normal vertical position, held there by the stop and counter balance 42 and urging against the bottom of the bill stack 64 to prevent the same from bulging at the center thereof. It will be appreciated that the same tab 38 also serves to prevent attempted unauthorized removal of bills from the stack as by stringing or the like.

It should also be appreciated that the provision of the angled rails 32 and ball rollers 54 allow for ease of transport of the bills along the rails and removal thereof by the punch 60. It will further be appreciated that accurate reading of the bill is achieved by the assured registration between the magnetic heads 76 and pressure members 72 within the note path 14.

Another feature of the invention is the provision of a punch 60 which is capable of reliably moving bills from the rails 32 and into the stack 64 of the cavity 66. As previously mentioned, the punch has typically been of a metal construction, having a low coefficient of friction, such that the bill could laterally move across the face of the punch. Accordingly, as the punch moved from left to right as shown in FIG. 3, to achieve removal of the bill from the rails 32, it was often found that only one side of the bill actually released from its associated rail, that edge being the one experiencing the lowest coefficient of friction in its interface with the rail. Accordingly, the bill often times would not be received within the stack 64, but would hang up on one of the rails. This was found to be particularly true with new bills having a stiff or crisp nature. It was also found that bills having a characteristic roll or fold would tend to wrap around the punch plate and, instead of being retained by the backside of the rails 32, would follow the punch plate back from the stack 64.

Figure 7:
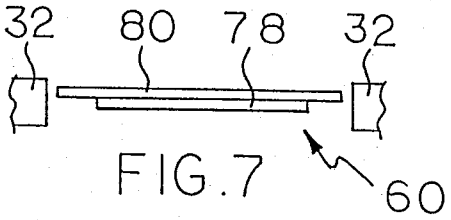
FIG. 7 is a top plan view of the punch of the invention positioned between the two side rails.
Figure 8:
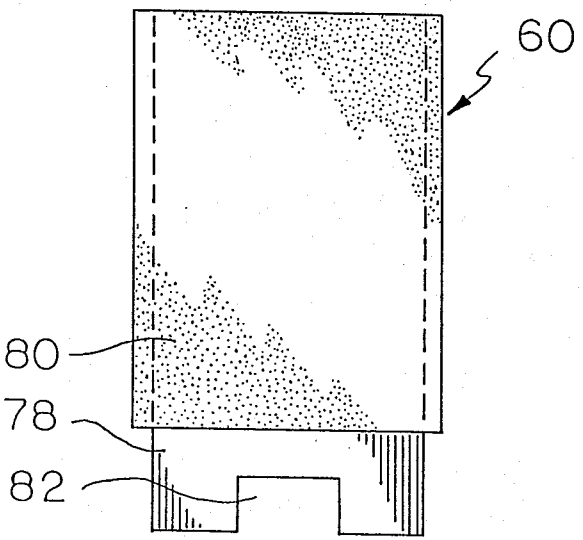
FIG. 8 is a front perspective view of the punch of FIG. 7.

In order to overcome these problems with the prior art, the structure of FIGS. 7 and 8 has been devised. As shown, the punch 60 comprises a back plate 78 of a rigid or stiff nature, preferably of metal or rigid plastic. Attached to the front of the back plate 78 is a pad 80 of a flexible material having a coefficient of friction sufficient to secure and engage paper currency and the like. A suitable pad 80 has been found to be comprised of rubber reinforced with fibers such as KEVLAR. It has been found that the desired flexibility of the pad 80 is obtained if the pad is on the order of 0.3–0.5 inch thick, and preferably 0.4 inch thick. Further, it will be seen that the pad 80 overhangs the sides of the plate 78, such overhang being 0.1–0.3 inch, and most preferably 0.2 inch on each side. In a preferred embodiment, the width of the plate 78 is approximately 1.4 inch such that the overall width of the pad 80 would be on the order of 1.8 inch. Finally, it has been found that the clearance between the sides of the pad 80 and the associated rail 32 is on the order of 0.04–0.08 inch and, most preferably, 0.06 inch.

It has been found with the structure just described that the pad 80 provides sufficient frictional engagement with the bill to remove the bill from both of the side rails 32 and to effectively stack the same in the stack 64. It has further been found that with stiff or crisp new bills, the side edges of the pad 80 which overhang the plate 78 flex slightly as they pass between the rails 32 and then recover their planar stature once the rails 32 have been cleared such that the bill received within the stack 64 may be held against the back side of the rails 32 as by the spring-biased backup plate 62. Further, it has found that by providing a minimum clearance between the rails 32 and the side edges of the pad 80 as described above, folded or rolled characteristics of the bills do not have a tendency to secure the bills to the punch assembly 60. This is due to the fact that the substantial width of the pad 80 flatens or smooths the bill over nearly its entire width and the close proximity between the edges of the pad 80 and the rails 32 preclude the bill from springing back therebetween.

It should be appreciated from reference to FIG. 8 that the pad 80 does not extend the entire length of the plate 78, but extends substantially the entire length thereof, stopping short of the notch 82 provided within the plate 78 for passage of the tab 38 in the manner described earlier herein. Finally, it is presented that the pad 80 preferably is characterised by a directionally oriented coefficient of friction. Most preferably, the longitudinal coefficient of friction (vertical as shown in FIG. 8) would be minimal, while the lateral coefficient of friction (horizontal as shown in FIG. 8) would be substantial. Such a feature allows the bills to move upwardly in the note path 14 and against the pad 80 with little impediment, while greatly restricting lateral movement across the path 80 such that the bills may be effectively removed from the side rails 32.

Thus it can be seen that the objects of the invention have been achieved by the structure presented hereinabove. While in accordance with the Patent Statutes only the best mode and preferred embodiment of the invention has been presented and described in detail, it is to be understood that the invention is not limited thereto or thereby. Accordingly, for an appreciation of the true scope and breath of the invention, reference should be had to the following claims.

What is claimed is:

1. A currency validator, comprising:

a note path having a horizontal portion leading to a vertical portion;

first sensing means at an end of said vertical portion for sensing the presence of a bill at said end;

second sensing means at a beginning of said vertical portion for sensing when a bill has been removed from said vertical portion; said second sensing means comprising a vane in operative communication with an optical interrupt, said vane being moved through said optical interrupt by removal of the bill from said vertical portion; and a punch plate adapted for reciprocating movement through said vertical portion for stacking the bill in a stack, said second sensing means further comprising a tab positioned for rotating passage through an opening in said plate and engaging a bottom portion of said stack.

2. The currency validator according to claim 1, wherein said first sensing means comprises a pivotal member in operative communication with an optical interrupt.

3. The currency validator according to claim 1 in which said punch plate is covered with a resilient pad.

4. The currency validator according to claim 3 wherein said pad is rubberized.

5. The currency validator according to claim 4 wherein said pad overlaps side edges of said plate.

6. A currency validator, comprising:

a note path having a horizontal portion leading to a vertical portion;

first sensing means at an end of said vertical portion for sensing the presence of a bill at said end; and a magnetic sensor positioned adjacent said note path at an intersection of said horizontal and vertical portions, said magnetic sensor being received within a flexible member, and wherein said note path comprises first and second plates, said flexible member bridging an opening in said first plate.

7. The currency validator according to claim 6 wherein said opening is positioned at a bend in said first plate, said bend interconnecting said horizontal and vertical portions.

8. A currency validator, comprising:

a note path having a horizontal portion leading to a vertical portion, said note path defined by a first plate spaced from a second plate, said first plate having an opening therein for receiving a magnetic sensor, said magnetic sensor being received by a resilient member spanning said opening, said opening being positioned at a bend in said note path, said bend interconnecting said horizontal and vertical portions.

9. The currency validator according to claim 8 wherein said resilient member is movable within said opening between ends thereof.

* * * * *